United States Patent [19]

Knapp et al.

[11] Patent Number: 4,698,555

[45] Date of Patent: Oct. 6, 1987

[54] CATHODE RAY TUBE DISPLAY SYSTEM

[75] Inventors: Alan G. Knapp, Crawley; Daphne L. Lamport, Godstone, both of England

[73] Assignee: U.S. Philips Corporation, New York, N.Y.

[21] Appl. No.: 939,584

[22] Filed: Dec. 9, 1986

[30] Foreign Application Priority Data

Jan. 30, 1986 [GB] United Kingdom ..... 8602300

[51] Int. Cl.[4] ..... H01J 29/70

[52] U.S. Cl. ..... 315/366; 313/422

[58] Field of Search ..... 315/366, 399; 313/422

[56] References Cited

U.S. PATENT DOCUMENTS

| | | | |
|---|---|---|---|
| 3,171,056 | 2/1965 | Gabor | 315/366 |
| 4,075,535 | 2/1978 | Genequand et al. | 315/366 |
| 4,658,188 | 4/1987 | Bohmer | 315/366 |
| 4,660,076 | 4/1987 | Knapp et al. | 315/375 |

FOREIGN PATENT DOCUMENTS

| | | | |
|---|---|---|---|
| 2101396 | 1/1983 | United Kingdom | 313/422 |

*Primary Examiner*—Theodore M. Blum
*Assistant Examiner*—David Cain
*Attorney, Agent, or Firm*—Robert J. Kraus

[57] ABSTRACT

A display tube of the kind in which a line-scanned, low-energy electron beam (32) is directed into a space between a planar array of elongate deflection electrodes (42) and the input side of a laminated dynode channel electron multiplier (44). The deflection electrodes are switched sequentially by driving means between two potential levels ($V_1$, $V_2$) so as to deflect and scan the incoming beam frame-wise over the multiplier input, the current-multiplied beam emanating from the multiplier being directed onto a screen (16) to produce a display. By ensuring that the beam acceleration voltage, Va, satisfies the relationship $1.3\ Vs < Va < 2\ Vs$, where $Vs = V_2 - V_1$, beam spot size at the multiplier input is maintained and Moirée patterning effects in the display are effectively suppressed. The multiplier input electrode and final anode of the electron gun are advantageously held at the higher ($V_2$) of the switched potentials.

3 Claims, 5 Drawing Figures

CATHODE RAY TUBE DISPLAY SYSTEM

BACKGROUND OF THE INVENTION

This invention relates to a cathode ray tube display system comprising a cathode ray display tube having means for producing an electron beam and directing the electron beam into a space between a planar array of elongate deflection electrodes and the input side of a laminated dynode channel electron multiplier, a screen disposed adjacent the output of the electron multiplier onto which the current multiplied beam from the multiplier is directed, and driving means connected to the electron beam producing and directing means and to the deflection electrodes for applying potentials thereto. The driving means is operable to provide an accelerating potential for the beam and to switch the potential applied to each of the deflection electrodes between a first predetermined potential $V_1$ and a second predetermined potential $V_2$ and to control the sequence in which each of the electrodes is switched so as to cause the electron beam entering the said space to be scanned across the input side of the multiplier.

A cathode ray display tube of the above kind is disclosed in British Patent Specification No. 2101396. The cathode ray tube described in this specification is generally flat and has an electron gun which directs a low energy electron beam parallel to the screen. A reversing lens at one end of the tube turns the beam through 180° such that it travels in an opposite direction parallel to the screen towards the space between the planar array of deflection electrodes and the input surface of the channel electron multiplier, both of which are arranged parallel to the screen. The deflection electrodes comprise vertically spaced, horizontally elongate electrodes which are selectively energisable to establish an electrostatic field having a component normal to the screen which deflects the electron beam in that space towards the input side of the multiplier. By progressively energising the deflection electrodes in turn, the point of deflection of the electron beam in the longitudinal direction of that space is correspondingly progressively moved so as to effect frame scanning. The deflected electron beam undergoes current multiplication within the electron multiplier and is then accelerated towards the screen by means of an accelerating electrostatic field between the output side of the multiplier and the screen. In order to achieve orthogonal scanning of the beam over the input of the multiplier in raster fashion, the tube further includes elastrostatic deflectors arranged adjacent the final anode of the electron gun and prior to the reversing lens which deflect the beam in a plane parallel to the screen, thereby effecting line scanning. Although the specific description of the flat display tube in this specification refers to line scanning in the horizontal direction by the electrostatic deflectors and field scanning in the vertical direction by the planar array of deflection electrodes, the display tube may be rotated through 90° so that the line scanning is vertical and the field scanning is horizontal. For convenience of description field/frame scanning will be taken to mean the lower of the two scanning speeds.

According to British Patent Specification No. 2101396, the display tube is operated by passing the initially accelerated electron beam produced by the gun through a field free space defined between a pair of planar electrodes situated on either side of the beam's path intermediate the gun and the reversing lens, which are held at 400 V. An electron beam acceleration voltage of 400 V is provided by applying 400 V to the gun's final anode. Line scan is effected by applying to the line deflectors a line scan waveform modulated at field frequency with a peak value of typically ±50 V. The input side of the electron multiplier is also held at 400 V whilst at the beginning of each frame scan the deflection electrodes are at 0 V but are brought up to 400 V in sequence so that the electron beam, having passed through the reversing lens, is initially deflected into the topmost apertures of the multiplier by the field created between the electrodes at 0 V and the 400 V input side of the multiplier. The electrodes are brought up to 400 V in turn so that a field free space is formed between those electrodes at 400 V and the input side of the multiplier and the point of deflection of the beam, determined by the next electrode in the group to be at 0 V, is progressively moved downwardly in the direction of the incoming beam. All the above specified voltages are with reference to the cathode potential of the electron gun at 0 V.

Whilst this known tube generally performs well, it has been found that visible Moirée patterning effects can be produced on the screen during operation which spoil the otherwise good quality picture obtained. Obviously these effects are irritating and distracting for the viewer and it is an object of the present invention to provide a display system which does not suffer in this respect or in which these effects are at least reduced to an acceptable level.

SUMMARY OF THE INVENTION

According to the present invention, a display system of the kind mentioned in the opening paragraph is characterised in that the beam acceleration voltage, Va, and the amplitude Vs of the voltage change applied to the deflection electrodes satisfy the relationship $1.3\ Vs < Va < 2\ Vs$ where $Vs = V_2 - V_1$.

The invention stems from a recognition of the fact that in the known tube described in British Patent Specification No. 2101396 using a laminated dynode channel electron multiplier and where $Vs = Va$ the potentials applied to the deflection electrodes and the input side electrode of the multiplier produce a very powerful focussing effect in the vertical direction during deflection giving the electron beam, at the point at which the beam enters the electron multiplier, a very small vertical spot size (1/e width around 0.25 mm). The channel pitch of the multiplier determines the resolution of the tube. The electron beam producing means is designed to give a horizontal spot size appropriate to the channel pitch. As the channel pitch of the multiplier used in this known tube, around 0.5 mm, is significantly greater than the vertical spot size obtained by the focussing action, the modulation depth of the Moirée patterning produced by beating between the scan lines and the channel rows in the multiplier is unacceptably large. By operating the display tube in accordance with the invention such that $2\ Vs > Va > 1.3\ Vs$ the vertical spot size of the beam entering the multiplier is increased, making the spot more nearly circular, and so the modulation depth of the Moirée patterning is reduced. This increase in spot size is caused mainly by the fact that the position of the point of best focus of the beam no longer coincides with the channel plate electron multiplier input side. A secondary effect serving to reduce Moirée patterning and resulting from the fact that 2

Vs>Va>1.3 Vs is that the landing angle, that is, the angle between the incoming electron beam and an imaginary vertical line from the surface of the multiplier, is greater in this case so that the projection of the beam width onto the multiplier input side is larger.

Another parameter which needs to be taken into consideration in determining the relationship between Va and Vs is the spacing between the array of deflection electrodes and the input side of the multiplier and the position of the incoming beam in this space which can affect to a small extent spot size at the multiplier input. This spacing, however, also affects field scan linearity and the spacing and beam position therefore are decided primarily with a view to providing optimum field scan linearity.

By having the aforementioned relationship between Va and Vs, other advantages in the operation of the tube are also obtained. As is described in the aforementioned British Patent Specification No. 2101396, linear ramps are used to drive the deflection electrodes. This manner of driving produces a periodic non-linearity in the vertical (field) scan which manifests itself as a visible banding structure on a blank raster. Operation of the tube with 2 Vs>Va>1.3 Vs and with a slight change in the geometry of the field deflection region reduces the amplitude of this non-linearity.

Furthermore, because Va>Vs it is possible for some of the backscattered electrons with energies in the range e.Va to e.Vs produced at the multiplier input to be collected on the deflection electrodes rather than being returned to the multiplier input at some distance from their point of origin, and thereby causing contrast degradation, as is the case in the earlier system where Va=Vs.

In a preferred embodiment, Va is chosen to be approximately equal to 1.7 Vs. For example, Va may be around 650 V and Vs around 400 V or Va may be around 1500 V and Vs around 900 V. Particularly good results have been achieved with potentials obeying this relationship.

Preferably, the final anode potential of the electron beam producing means is substantially equal to the higher of the first and second predetermined potentials $V_1$ and $V_2$ and to the potential of the input side of the multiplier. In this way field free regions are conveniently obtained after the beam has been accelerated through the acceleration potential.

BRIEF DESCRIPTION OF THE DRAWING

A display system in accordance with the present invention will now be described, by way of example, with reference to the accompanying drawing figures in which.

DESCRIPTION OF THE PREFERRED EMBODIMENT

Figure 1:
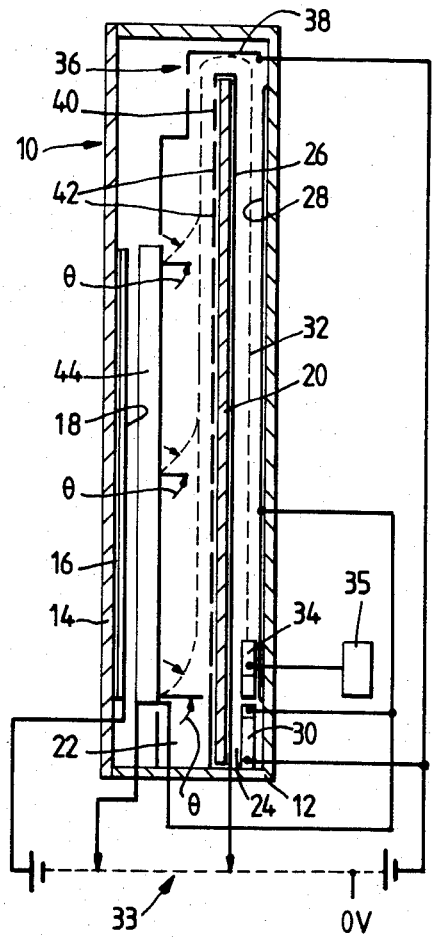
FIG. 1 is a diagrammatic cross-section through the display tube of the system.

The display tube 10 is flat and comprises an envelope 12 including an optically transparent, planar faceplate 14. On the inside of the faceplate 14 is a cathodoluminescent screen 16 with an electrode 18 thereon. The interior of the envelope 12 is divided in a plane parallel to the faceplate 14 by an internal partition or divider 20 to form a front portion 22 and a rear portion 24. The divider 20, which comprises an insulator such as glass, extends for substantially a major part of the height and width of the envelope 12. A planar electrode 26 is provided on a rear side of the divider 20. The electrode 26 extends over the exposed edge of the divider 20 and continues for a short distance down its front side. Another electrode 28 is provided on the inside surface of a rear wall of the envelope 12.

Means 30 for producing an upwardly directed low energy electron beam 32 is provided in the rear portion 24 adjacent a lower edge of the envelope 12. The means 30 may be an electron gun of the hot or cold cathode type. An upwardly directed electrostatic beam deflector 34 is spaced by a short distance from the final anode of the electron beam producing means 30 and is arranged substantially coaxially therewith. If desired the beam deflector 34 may be electromagnetic.

At the upper end of the interior of the envelope 12 there is provided a reversing lens 36 comprising an inverted trough-like electrode 38 which is spaced above the upper edge of the divider 20. By maintaining a potential difference between the electrodes 26 and 38 the electron beam 32 is reversed in direction whilst continuing along the same angular path from the line deflector 34.

On the front side of the divider 20 there are provided a plurality of laterally elongate electrodes vertically spaced in a planar array in which the uppermost electrode 40 may be narrower and acts as a correction electrode. The other electrodes 42 are selectively energised to provide field deflection of the electron beam 32 onto the input surface of a laminated dynode channel electron multiplier 44. A laminated dynode electron multiplier 44 and its operation is described in a number of published patent specifications examples of which include British Patent Specifications Nos. 1,401,969, 1,434,053 and 2023332A whose disclosures are incorporated herein by reference. Accordingly this type of electron multiplier 44 will not be described in detail but, for those not familiar with it, the electron multiplier comprises a stack of spaced apart, apertured mild steel plates held at progressively higher voltages. The apertures in the plates are aligned and contain a secondary emitting material. An electron striking the wall of an aperture in a first dynode produces a number of secondary electrons, each of which on impacting with the wall of an aperture in a second dynode produces more secondary electrons, and so on. In this embodiment, the multiplier has a 4:3 aspect ratio with a 305 mm diagonal and has approximately 170,000 channels of 0.55 mm pitch.

The stream of electrons leaving the final dynode are accelerated towards the screen 16 by an accelerating field maintained between the output of the electron multiplier 44 and the electrode 18.

The display tube 10 is described in greater detail in British Patent Specification No. 2101396 and reference is invited to this specification for further information regarding its construction and operation.

In order to drive the tube, the system further includes a power supply 33 having a variety of voltage outputs, a line deflection output stage, represented at 35, connected to the line deflector 34, and a field deflector circuit 43 having a plurality of outputs each connected to a respective one of the electrodes 42.

In the operation of the display tube to produce a television raster the following examples of typical voltages are applied with reference to ground potential (0 V). The cathode potential of the electron gun 30 is −250 V and the electron gun final anode at 400 V, giving an electron beam acceleration potential of 650 V. The electrodes 26, 28 in the rear portion 24 of the envelope 12 are at 400 V to define a field free space in which line deflection takes place with a line scan waveform modulated at field frequency and having a peak value of around ±50 V applied to the beam deflector 34 by the line deflection output stage 35. As the angular deflection of the electron beam continues after a reflection of 180° in the reversing lens 36 then the maximum angles need only be about ±26°. The trough-like electrode 38 of the reversing lens is at −250 V compared to the 400 V of the extension of the electrode 26 over the top edge of the divider 20. The input surface of the electron multiplier 44 is at 400 V whilst at the beginning of each field scan at least the upper electrodes 42 are at 0 V but are ramped up to 400 V in a sequence to be described so that the electron beam 32 in the front portion 22 is initially deflected into the topmost apertures of the electron multiplier 44, and subsequently the electrodes 42 are brought up to 400 V to form a field free space with the electron multiplier 44 in the vicinity of the next electrode 42 in the group to be at 0 V. The landing angles $\theta$ of the electron beam 32 are fairly constant over the input side of the electron multiplier. The field deflection circuit 43 applies the required ramp voltages (0–400 V) to the respective electrodes 42. In the laminated plate electron multiplier 44 the voltage across each dynode of the electron multiplier 44 is typically +300 V per stage although the precise voltage depends on the secondary emitter used and could be as high as 500 V. Thus for a 7 dynode multiplier the total potential difference is 1.8 kV which, allowing for the 400 V on the input side of the multiplier, means that the potential at the output side is equal to 2.2 kV. The electrode 18 is typically at a potential of 11 kV to form an accelerating field between the output side of the electron multiplier 44 and the screen 16. The timing of commencement of energisation of the electrodes 42 is chosen to suit the tube and its application. However for a television raster, a suitable timing cycle, described in British Patent Specification No. 2101396, is to commence with the first of the field scanning electrodes 42 at 200 V and the second of the electrodes 42 at 0 volts. Both electrodes are then energised so that their voltages increase linearly with time. As the first electrode reaches 400 V and the second electrode reaches 200 V then the third electrode 42 commences its energisation. As the third electrode reaches 200 V, the next electrode begins its energisation, and so on. For further information regarding this timing cycle, reference is invited to British Patent Specification No. 2101396.

Figure 3:
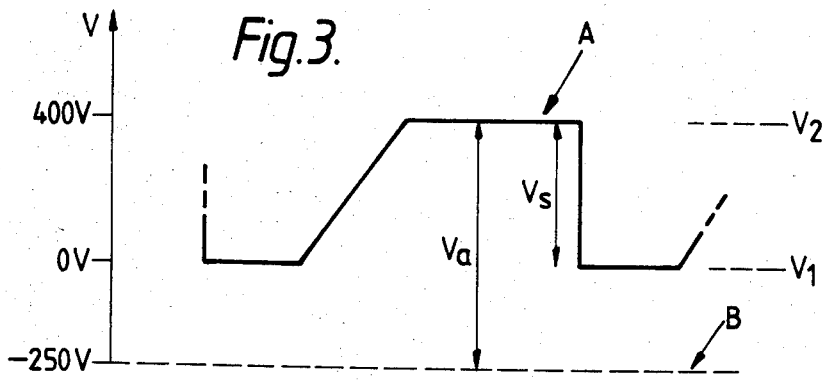
FIG. 3 shows a portion of an example of the field scan voltage waveform applied to a typical one of the field scan deflector electrodes of the tube of FIG. 1.

A portion of the voltage waveform applied to a typical one of the electrodes 42 is shown in FIG. 3. As can be seen from this figure, the voltage applied to the electrode, designated by A, is increased linearly from zero ($V_1$) to 400 V ($V_2$), this potential difference being denoted by Vs (i.e. $V_2-V_1$) and is maintained at that level for a period (whose duration is dependent on the position of the electrode in the array) before dropping to zero again at the termination of the field scan (flyback), signifying the beginning of the next field scan. The potentials applied to both the input surface of the electron multiplier and the final anode of the gun correspond to the peak voltage of waveform A, i.e. 400 V. The relative potential applied to the electron gun cathode is represented by the broken line B in FIG. 3 and is at −250 V. Thus the electron beam acceleration potential, denoted by Va in FIG. 3, is 650 V.

Figure 4A:
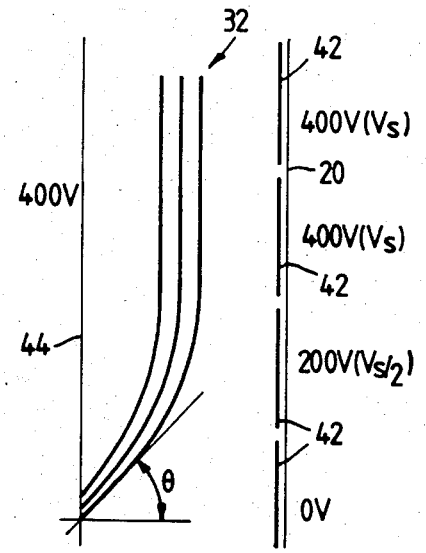
FIGS. 4*a* and 4*b* are enlarged diagrammatic views of a part of the display tube of FIG. 1 and illustrate respectively a portion of a typical electron beam trajectory in the display system according to the invention, and, for comparison, a corresponding typical electron beam trajectory portion in a known display system.
Figure 4B:
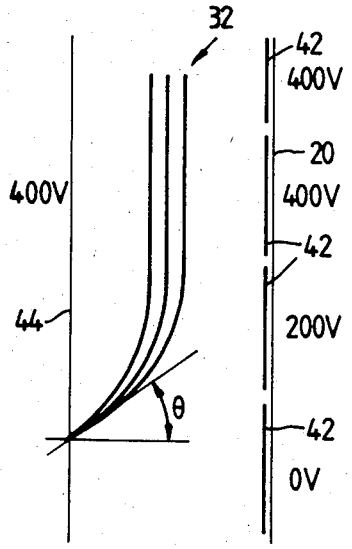

By arranging that the amplitude of the scan ramp voltages (Vs) is less than the electron beam acceleration voltage (Va), the problem of Moirée patterning encountered heretofore is overcome. Referring to FIG. 4*a*, there is shown diagrammatically a portion of the region between the divider 20 and the input surface of electron multiplier 44 of the tube and in which just four of the electrodes 42 are present. The incoming electron beam 32, having an energy equal to e.Va, that is, 650 eV, is deflected onto the input side of the multiplier 44 by appropriate potentials being applied to the electrodes as described above, field scanning being achieved by changing those potentials in sequence in the aforementioned manner. Line scanning of the beam over the input side of the multiplier, effected by deflector 34, is at right angles to the plane of the drawing. Because Va>Vs, (more precisely Va=1.625Vs), the vertical spot size of the beam where it meets the multiplier is relatively large, typically around 0.8 mm. For comparison, FIG. 4*b* illustrates an earlier arrangement in which the beam acceleration voltage (Va) is equal to the amplitude of the scan ramp voltage (Vs), namely 400 V, and thus in which the beam energy equals e.Vs, that is, 400 eV. As can be seen, in these circumstances the beam is strongly focussed in the vertical direction so that it has a very small vertical spot size (typically 0.25 mm 1/e width).

By arranging that Va>Vs, and hence producing a beam spot having a larger vertical size at the multiplier, it has been found that the Moirée patterning in the display associated with the earlier arrangement is no longer present.

A contributing cause for the fact that the vertical beam spot size is increased is the angle at which the beam meets the surface of the multiplier. As can be seen by comparing FIG. 4*a* and 4*b*, this angle, designated $\theta$ in the Figures, is greater in the case where Va>Vs, (around 50° compared with 35°) so that the projection of the beam width onto the multiplier is greater. The angle $\theta$ depends on the ratio Va/Vs. For the range of Va/Vs values from 1.3 to 2.0 the angle $\theta$ varies from 40° to 60° but for the given ratio of Va/Vs=1.625 the angle $\theta$ is 49±3°.

Particularly good results are achieved with the ratio of Va to Vs around 1.7:1, although a certain amount of variation within the preferred range 1.3 Vs<Va<2 Vs is possible. However, as the ratio approaches, on the one hand, 1:1 the vertical beam spot size reduces so that the problem of Moirée patterning can again occur. On the other hand, as the ratio increases, blurring of the picture can result from the vertical spot size increasing to an extent such that it scans over two rows of apertures in the multiplier simultaneously.

Whilst certain examples of applied voltages have been described, other voltages may be used instead. For example, the beam acceleration voltage (Va) could be increased to 1500 V and the amplitude of the ramp scan increased correspondingly to 900 V, giving a ratio of Va to Vs of 1.67. Other values of Va may be adopted although it is desirable that Va be maintained less than 2.5 kv. Moreover, although in the specific embodiment described the voltages applied are with reference to ground potential (0 V) of the unramped electrodes 42, the ground potential (0 V) may instead be used as the potential for either the electron gun cathode or electron multiplier input so long as the desired field free regions after the final anode of the gun between the electrodes 26 and 28, and between the input of the multiplier and the ramped electrodes 42 and the relationship between Va and Vs are still obtained.

In the embodiment shown in the drawing figures, the electron beam producing means 30 and line deflector 34 have been shown disposed at the lower end of the envelope 12 and the reversing lens 36 at the top end of the envelope 12. However in an alternative, non-illustrated embodiment the beam producing means 30 and the line deflector 34 can be arranged at the top end of the envelope 12 with the reversing lens at the bottom end. In order to carry out field deflection it is necessary at the commencement of each scan to have all the electrodes 42 at 400 V to provide a field free space between them and the electron multiplier 44 and then to bring each electrode 42 in turn down to zero volts commencing at the top to deflect the electron beam 32 onto the input of the electron multiplier 44.

Figure 2:
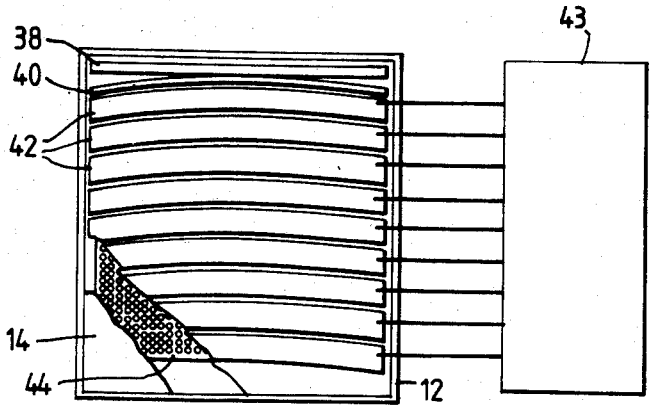
FIG. 2 is a diagrammatic view of the display tube of FIG. 1 with the faceplate and electron multiplier broken away to show the field deflection electrodes and the electrical connections thereto.

In a further non-illustrated embodiment the display tube shown in FIGS. 1 and 2 can be rotated through 90° so that the electrodes are generally vertical and the electron beam emerges from the electron beam producing means 30 in a generally horizontal direction.

A suitable field deflector circuit for driving the electrodes 42 is described in British Patent Specification No. 2164829A whose disclosure is incorporated herein by reference, the deflector circuit being adapted to provide the required output voltages if necessary.

We claim:

1. A cathode ray tube display system comprising a cathode ray display tube having means for producing an electron beam and directing the electron beam into a space between a planar array of elongate deflection electrodes and the input side of an electron multiplier, a screen disposed adjacent the output of the electron multiplier onto which the current multiplied beam from the electron multiplier is directed, and driving means connected to the electron beam producing and directing means and to the deflection electrodes for applying potentials thereto, the driving means being operable to provide an accelerating potential for the beam and to switch the potential applied to each of the deflection electrodes between a first predetermined potential $V_1$ and a second predetermined potential $V_2$ and to control the sequence in which each of the electrodes is switched so as to cause the electron beam entering the space to be scanned across the input side of the electron multiplier, characterised in that the beam acceleration voltage Va and the amplitude Vs of the voltage change applied to the deflection electrodes satisfy the relationship $1.3\ Vs < Va < 2\ Vs$, where $Vs = V_2 - V_1$.

2. A cathode ray tube display system according to claim 1, characterised in that Va is approximately equal to 1.7 Vs.

3. A cathode ray tube display system according to claim 1 or claim 2, characterised in that the final anode potential of the electron beam producing means is substantially equal to the higher of the first and second predetermined potentials $V_1$ and $V_2$ and to the potential of the input side of the electron multiplier.

* * * * *